United States Patent [19]

Reed

[11] Patent Number: 4,841,671

[45] Date of Patent: Jun. 27, 1989

[54] THREE-PIECE PLANT POT HANGER

[76] Inventor: Edward W. Reed, 537 Calle Grande Cir., Santa Maria, Calif. 93455

[21] Appl. No.: 224,366

[22] Filed: Jul. 26, 1988

[51] Int. Cl.[4] ..... A01G 9/02

[52] U.S. Cl. ..... 47/67; 248/312.1

[58] Field of Search ..... 47/39, 66, 67; 248/311.2, 312.1, 313, 558

[56] References Cited

U.S. PATENT DOCUMENTS

| | | | |
|---|---|---|---|
| 2,451,550 | 10/1948 | Haller | 47/67 |
| 2,967,691 | 1/1961 | Lehnbeuter | 47/67 |
| 3,091,424 | 5/1963 | Yegge | 248/313 |
| 4,422,610 | 12/1983 | Hunt | 248/311.2 |
| 4,623,113 | 11/1986 | Studebaker | 248/311.2 |

*Primary Examiner*—Robert A. Hafer
*Assistant Examiner*—Lynda M. Cofsky
*Attorney, Agent, or Firm*—Marvin E. Jacobs

[57] ABSTRACT

A plant pot hanger for releasably supporting a plant pot has rear, middle and front support members. The rear member has a bracing portion projecting outwardly to an outer end adapted to engage and laterally support a tapered body of the pot at a location spaced below a collar thereof. The middle member has a bracing part projecting outwardly to an outer end adapted to engage and laterally support the tapered body at a location spaced above the bracing portion of the rear member and at lower edge on the pot collar. The front member is adapted to engage an interior side of the pot collar and is attachable along with the middle and rear members to a vertical mounting surface. The outer end of the bracing portion of the rear member is disposed outwardly beyond the outer end of the bracing part of the middle member such that the respective outer ends together define a pitch line at a given angle relative to the vertical. The rear and middle members are slidable longitudinally relative to one another for varying the distance between their respective bracing portion and part and thereby changing the angle relative to the vertical of the pitch line defined by the outer ends thereof for matching the pitch line of the tapered body of the pot to be supported by the hanger.

18 Claims, 6 Drawing Sheets

THREE-PIECE PLANT POT HANGER

BACKGROUND OF THE INVENTION

The present invention relates generally to devices for hanging plant pots and, more particularly, is concerned with a three-piece plant pot hanger.

A conventional plant pot generally has a frusto-conical shaped body being larger in diameter at its open upper end than at its closed lower end, and an upper outer annular cylindrical collar on the upper end of the body. The upper collar typically has a stepped profile defining a lower outer annular shoulder at the upper end of the frusto-conical body.

It is currently popular to support plant pots at elevated locations on a vertical wall or support post by use of pot holders or hangers. Representative of the prior art pot hangers are the ones disclosed in U.S. Patents to Allderdice (U.S. Pat. No. 2,266,294), Pisano (U.S. Pat. No. 2,554,120), Lehnbeuter et al (U.S. Pat. No. 2,967,691), Yegge (U.S. Pat. No. 3,091,424), Thurman et al (U.S. Pat. No. 3,193,234), Chernewski (U.S. Pat. No. 4,071,976), Hunt (U.S. Pat. No. 4,422,610) and Studebaker (U.S. Pat. No. 4,623,113). Many of the hangers support the plant pot by engaging its upper collar and bottom. Others engage the pot inside the upper collar and below the lower shoulder of the collar. It is felt that many of these hangers provide an inadequate number and distribution of contact points with the plant pot for providing adequate support to the elevated plant pot.

One pot hanger, that of the Hunt patent, appears to take an approach having promise for improving the support capability of the hanger by providing a separate support point along the slanted side wall of the pot body. More particularly, in the hanger of this patent, a vertical base member is provided with first and second vertically spaced abutments which project laterally outward from the front face of the base member. The upper of these two abutments serves as a supporting ledge for the stepped collar of the plant pot and both abutments are sized and arranged to laterally abut the frusto-conical body of the pot at two different support points.

Also, in the Hunt hanger, a clamping member slidably interfits within channels defined on the rear face of the base member. The clamping member has downwardly and outwardly projecting hook portions which extend into the open top of the pot in engagement with the interior surface of the upper collar. The clamping member hook portions clamp the collar against the upper abutment of the hanger.

The clamping member can be vertically adjusted relative to the base member and thereby relative to the first abutment for accommodating therebetween pots having different size upper collars. However, the inability to adjust the upper and lower abutments relative to one another is a major drawback of the Hunt hanger design. The two abutments at their inner edges together can define a fixed pitch line at only a single given angle relative to the vertical making the abutments engageable only with a frusto-conical pot side wall having that same pitch angle relative to the vertical.

Although the Hunt hanger design might provide a rigidly secure mounting configuration for a plant pot, it is limited to use with pots having frusto-conical side walls at the same pitch angle. In order to accommodate plant pots having side walls of different pitch angles, the Hunt hanger requires an additional accessory which supports the pots at their bottoms. Thus, the above-mentioned drawback of the Hunt hanger design necessitates the added expense of another part.

Consequently, a need exists for improvements in hanger construction which will retain the increased number and improved distribution of contact points supporting a plant pot as provided in the Hunt design but will eliminate the above-mentioned drawback associated therewith.

SUMMARY OF THE INVENTION

The present invention provides a three-piece plant pot hanger designed to satisfy the aforementioned needs. The hanger of the present invention has adjustable features which allow changing the angle relative to the vertical of the pitch line defined by two support points thereof so as to accommodate plant pots having bodies or side walls of different frusto-conical configurations.

Accordingly, the present invention is directed to a plant pot hanger for releasably supporting a plant pot having a tapered body larger in size at an upper end than at a lower end thereof and an upper annular collar at the upper end of the body. The hanger comprises the combination of: (a) a rear support member including a bracing portion projecting outwardly to an outer end adapted to engage and laterally support the tapered body of the plant pot at a location spaced below the collar of the pot; (b) a middle support member including a bracing part projecting outwardly to an outer end adapted to engage and laterally support the tapered body of the plant pot at a location spaced above the bracing portion of the rear support member and at a lower edge of the collar of the pot; and (c) a front support member adapted to engage an interior side of the collar of the pot and for attachment with the middle and rear support members to a generally vertical mounting surface. The outer end of the bracing portion of the rear support member is disposed outwardly beyond the outer end of the bracing part of the middle support member such that the respective outer ends together define a pitch line at a given angle relative to the vertical. Further, the rear and middle support members are movable longitudinally relative to one another for varying the distance between their respective bracing portion and part and thereby changing the angle relative to the vertical of the pitch line defined by the outer ends thereof for matching the pitch line of the tapered body of the plant pot to be supported by the hanger.

More particularly, the rear support member of the hanger also includes an elongated mounting portion being adapted to engage the generally vertical mounting surface from which the plant pot is to be supported by the hanger. The bracing portion of the rear support member is connected to and projects transversely outwardly from a lower end of the mounting portion thereof.

Further, the middle support member of the hanger also includes an elongated mounting part being adapted at a rear side thereof to engage the mounting portion of the rear support member and at a front side thereof to engage an exterior side of the collar of the pot. The mounting part of the middle support member has an elongated channel defined in the rear side thereof for slidably receiving the mounting portion of the rear support member. The bracing part of the middle support member is connected to and projects transversely outwardly from a lower end of the mounting part thereof.

The front support member of the hanger includes an elongated retaining portion and an engaging portion. The retaining portion is adapted to engage the interior side of the collar of the pot. The engaging portion is connected to and projects transversely outwardly from an upper end of the retaining portion and is adapted at its outer end to engage the mounting part of the middle support member adjacent to an upper end thereof.

The retaining portion of the front support member has an aperture defined therethrough adjacent the upper end of the retaining portion and below the engaging portion of the front support member. The mounting part of the middle support member has an aperture defined therethrough adjacent an upper end of the mounting part. The mounting portion of the rear support member has a longitudinally-extending slot defined therethrough.

The front support member is capable of being adjustably displaced along the middle support member for aligning the aperture of the front support member with the aperture of the middle support member above an upper edge of the collar of the pot when the latter is disposed between the retaining portion and mounting part of the respective front and middle support members. Furthermore, the front and middle support members are capable of being adjustably displaced along the rear support member for aligning the apertures with the longitudinal slot in the rear support member for insertion of a fastener therethrough for attaching the support members to the generally vertical mounting surface.

These and other features and advantages of the present invention will become more apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

DETAILED DESCRIPTION OF THE INVENTION

Figure 1:
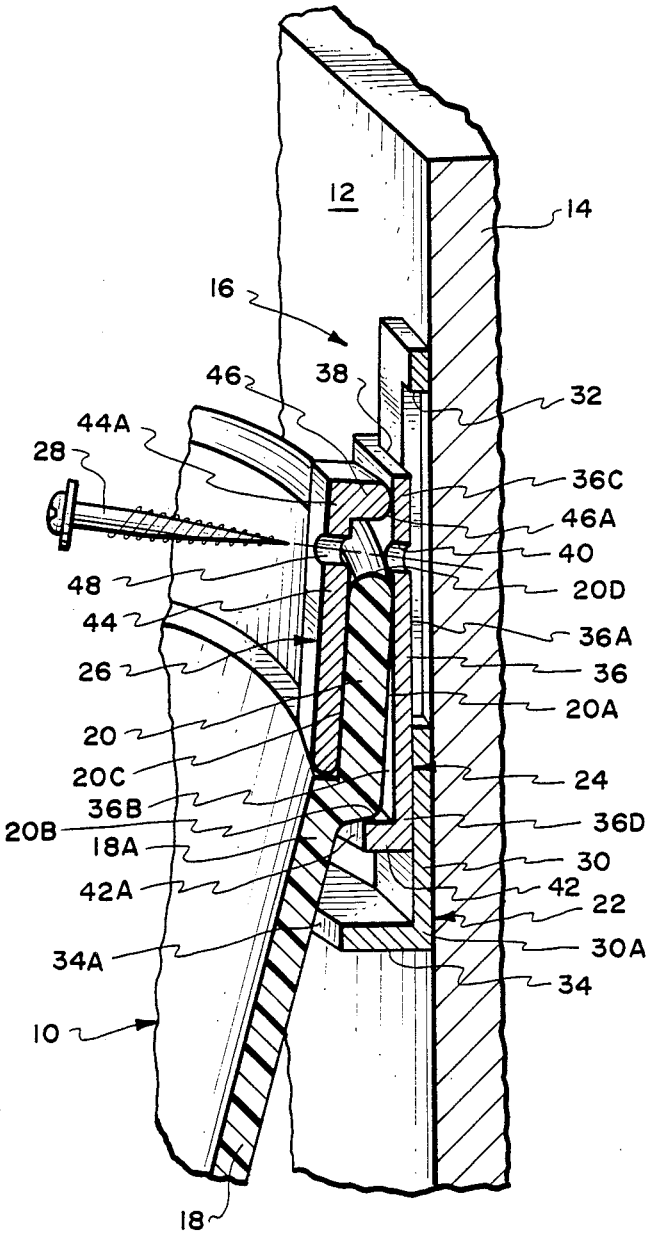
FIG. 1 is a fragmentary perspective view of a plant pot supported from a vertical surface by the hanger of the present invention being shown sectioned along the longitudinal centerline thereof.
Figure 3A:
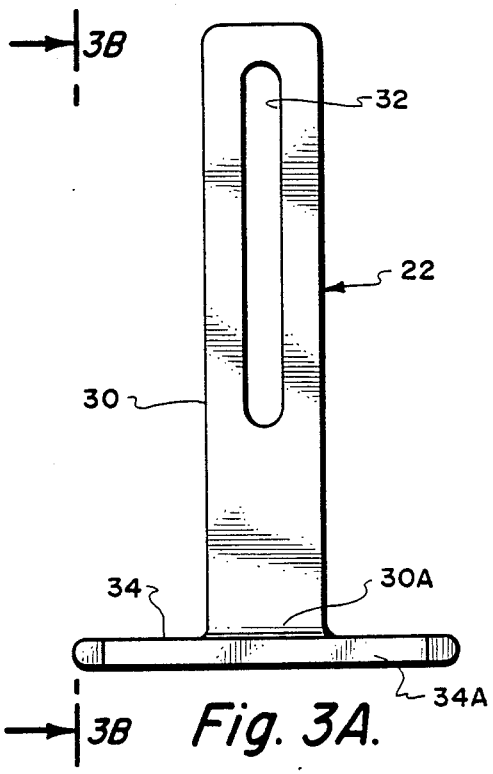
FIG. 3A is a front elevational view of a rear support member of the hanger of FIGS. 1 and 2.
Figure 3B:
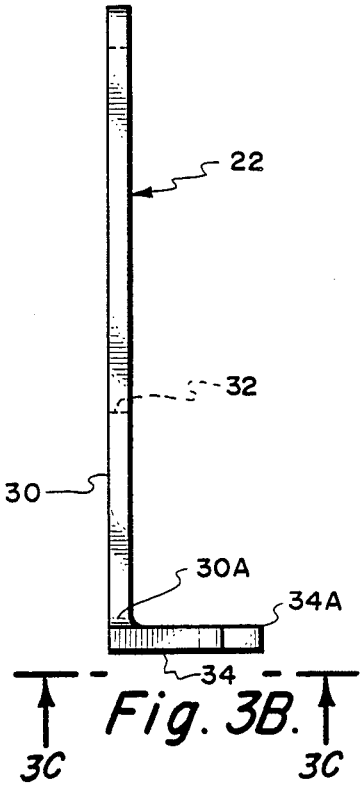
FIG. 3B is a side elevational view of the rear support member as seen along line 3B—3B of FIG. 3A.
Figure 2:
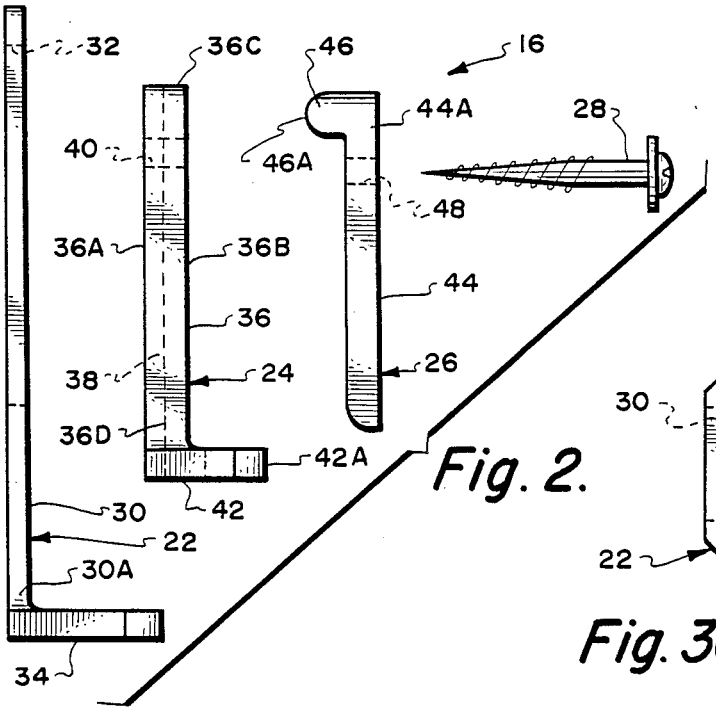
FIG. 2 is an exploded side elevational view of one embodiment of the three-piece hanger of the present invention together with a screw fastener.
Figure 3C:
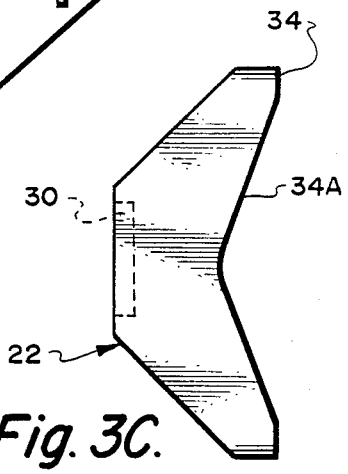
FIG. 3C is a bottom plan view of the rear support member as seen along line 3C—3C of FIG. 3B.
Figure 4A:
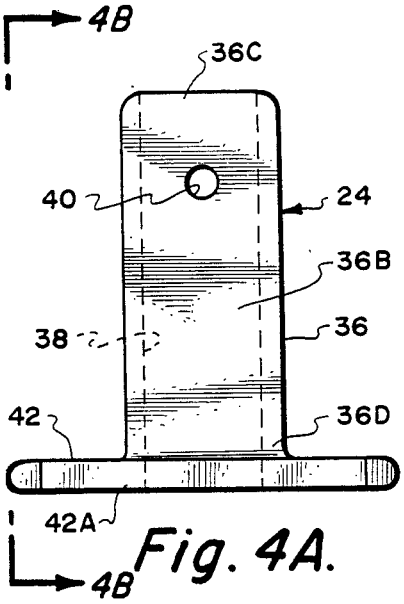
FIG. 4A is a front elevational view of a middle support member of the hanger of FIGS. 1 and 2.
Figure 4B:
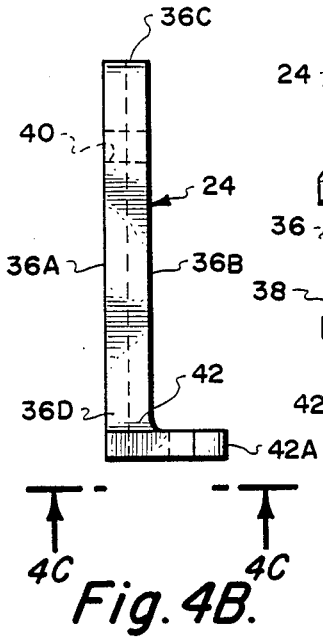
FIG. 4B is a side elevational view of the middle support member as seen along line 4B—4B of FIG. 4A.
Figure 4C:
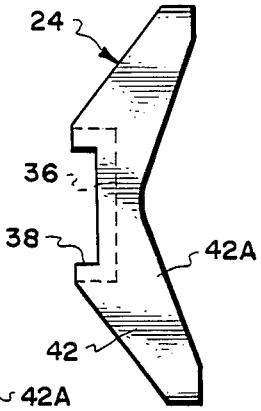
FIG. 4C is a bottom plan view of the middle support member as seen along line 4C—4C of FIG. 4B.
Figure 5A:
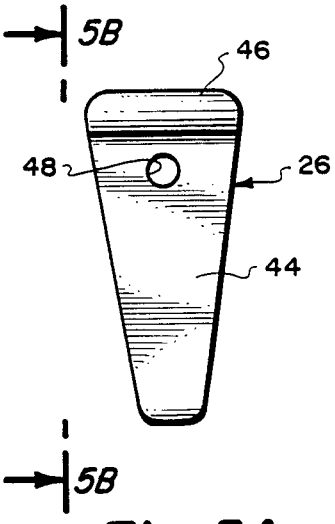
FIG. 5A is a front elevational view of a front support member of the hanger of FIGS. 1 and 2.
Figure 5B:
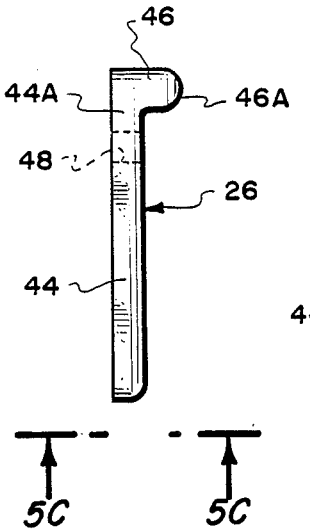
FIG. 5B is a side elevational view of the front support member as seen along line 5B—5B of FIG. 5A.
Figure 5C:
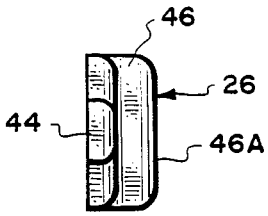
FIG. 5C is a bottom plan view of the front support member as seen along line 5C—5C of FIG. 5B.

Referring now to the drawings, and particularly to FIG. 1, there is shown, in fragmentary form, a plant pot 10 and generally vertical surface 12 of a support structure 14, and a plant pot hanger 16, in longitudinal section and constructed in accordance with the present invention, for releasably supporting the plant pot 10 from the wall surface 12. The plant pot 10 is of the conventional type having a tapered side wall or body 18, being larger in size or diameter at an upper end 18A than at a lower end (not shown) thereof, and an upper annular cylindrical collar 20 at the upper end 18A of the pot body 18.

Referring to FIGS. 1–5, the plant pot hanger 16 basically includes a rear support member 22, a middle support member 24 and a front support member 26. A metal screw 28 is provided for fastening the members 22–26 to the support structure 14. In the embodiment illustrated in FIGS. 1–5, the members 22–26 are fabricated from a suitable plastic, such as high impact polystyrene or from metal.

More particularly, the rear support member 22 of the hanger 16 has an elongated planar mounting portion 30 being adapted to engage and lie flush against the vertical mounting surface 12 of the support structure 24 from which the plant pot 10 is to be supported by the hanger 16. The mounting portion 30 of the rear member 22 preferably has a longitudinally-extending slot 32 defined therethrough which is closed at its opposite ends. The rear support member 22 also has a planar bracing portion 34 projecting outwardly in a generally shallow V-shaped configuration to an outer arcuate edge or end 34A adapted to engage and laterally support the tapered body 18 of the plant pot 10 at a location spaced below the collar 20 of the pot 10, as seen in FIG. 1. The bracing portion 34 is rigidly connected to and projects orthogonally or transversely outwardly from a lower end 30A of the mounting portion 30.

The middle support member 24 of the hanger 16 includes an elongated planar mounting part 36 being both wider and shorter than the mounting portion 30 of the rear member 22. The mounting part 36 of the middle member 24 has a longitudinal channel 38 on its rear side 36A extending from end-to-end in which the mounting portion 30 of the rear member 22 engageably fits and along which it can slidably move relative to the middle member 24. At a front side 36B, the mounting part 36 of the middle member 24 is adapted to engage with an exterior side 20A of the pot collar 20. An aperture 40 is defined through the mounting part 36 adjacent an upper end 36C thereof.

The middle support member 24 of the hanger 16 also includes a planar bracing part 42 projecting outwardly in a shallow V-shaped configuration, similar to the bracing portion 34 of the rear member 22, to an outer arcuate edge or end 42A adapted to engage and laterally support the tapered body 18 of the plant pot 10 at a location spaced above the bracing portion 34 of the rear member 22 and at a lower edge 20B of the pot collar 20. The bracing part 42 of the middle member 24 is rigidly connected to and projects orthogonally or transversely outwardly from a lower end 36D of the mounting part 36.

The front support member 26 of the hanger 16 is adapted to engage an interior side 20C of the pot collar 20. When the members 22–26 are attached to the mounting surface 12, the middle and front members 24, 26 capture and hold the collar 20 of the pot 10 between them. More particularly, the front support member 26 includes an elongated planar retaining portion 44 and an upper engaging portion 46. The retaining portion 44 is adapted to engage the interior side 20C of the collar 20. The engaging portion 46 in the form of a rib is rigidly connected to and projects orthogonally or transversely outwardly from an upper end 44A of the retaining portion 44 and being adapted at its outer end 46A to engage the upper end 36C of the mounting part 36 of the middle member 24 just above the aperture 40 therein. Another aperture 48 is defined through the retaining portion 44 adjacent to its upper end 44A just below the engaging portion 46 of the front member 26.

As seen in FIG. 1, the front support member 26 is capable of being adjustably displaced vertically along the middle support member 24 for aligning the aperture 48 of the front member 26 with the aperture 40 of the middle member 24 above an upper edge 200 of the pot collar 20. Furthermore, the middle and front members 24, 26 together are capable of being adjustably displaced vertically along the rear support member 22 for aligning the apertures 40, 48 with the longitudinal slot 32 in the rear member 22 and for bringing the bracing portion 34 of the rear member 22 into engagement with the pot body 18. Upon insertion of the fastener screw 28 through the apertures 40,48 and the slot 32, the screw 28 can be tightened down for rigidly attaching and locking all of the support members 22–26 and the pot 20 therewith to the generally vertical mounting surface 12 of the support structure 14.

Figure 6:
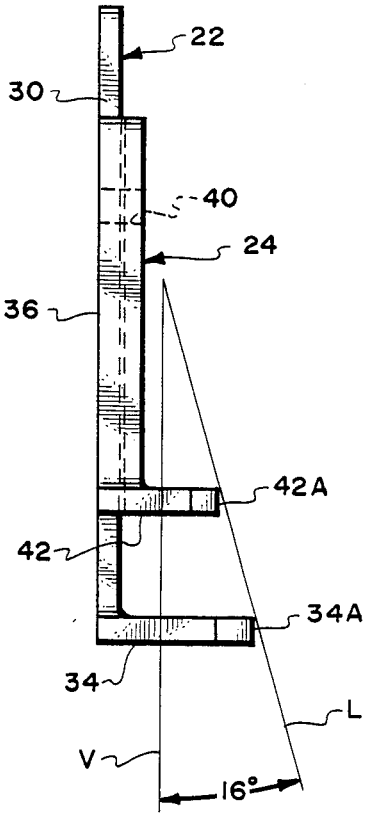
FIG. 6 is a side elevational view of the rear and middle support members of the hanger of FIGS. 1 and 2 assembled in first axially displaced positions relative to one another in which they define a first pitch angle.
Figure 7:
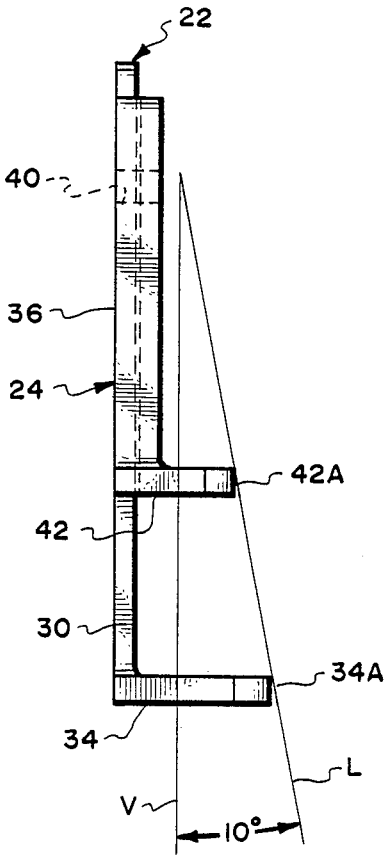
FIG. 7 is a side elevational view of the rear and middle support members of the hanger similar to FIG. 6, but showing them assembled in second axially displaced positions relative to one another in which they define a second pitch angle.
Figure 9A:
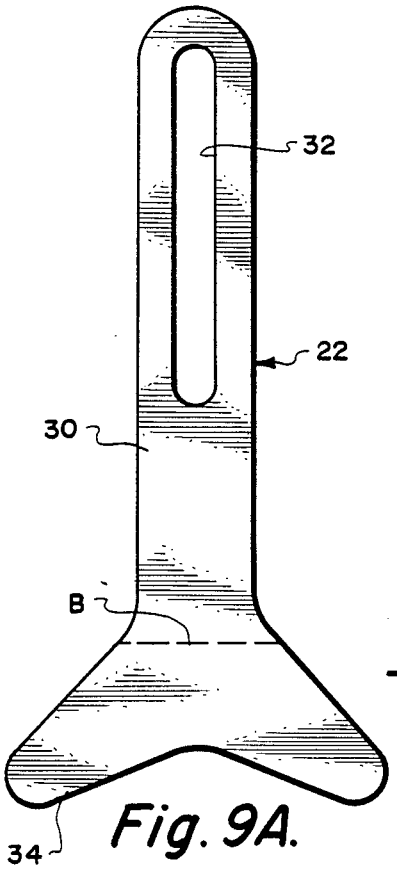
FIG. 9A is a front plan view of an unbent blank of a rear support member of the hanger of FIG. 8.
Figure 9B:
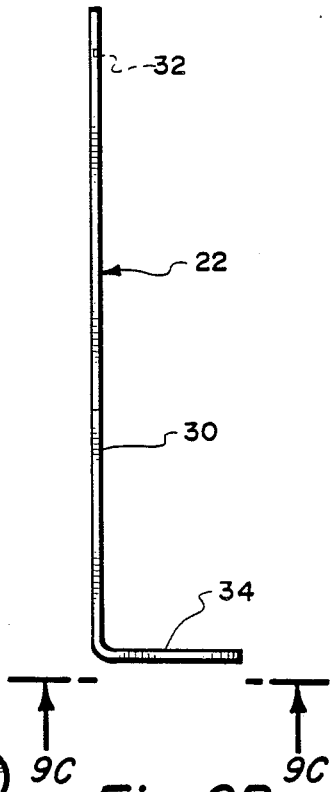
FIG. 9B is a side elevational view of the rear support member of the hanger of FIG. 8 after bending of the blank of FIG. 9A.
Figure 9C:
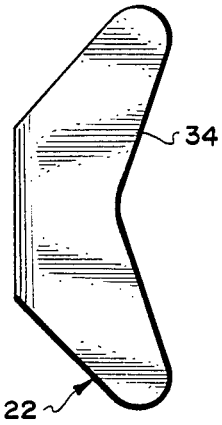
FIG. 9C is a bottom plan view of the rear support member as seen along line 9C—9C of FIG. 9B.
Figure 8:
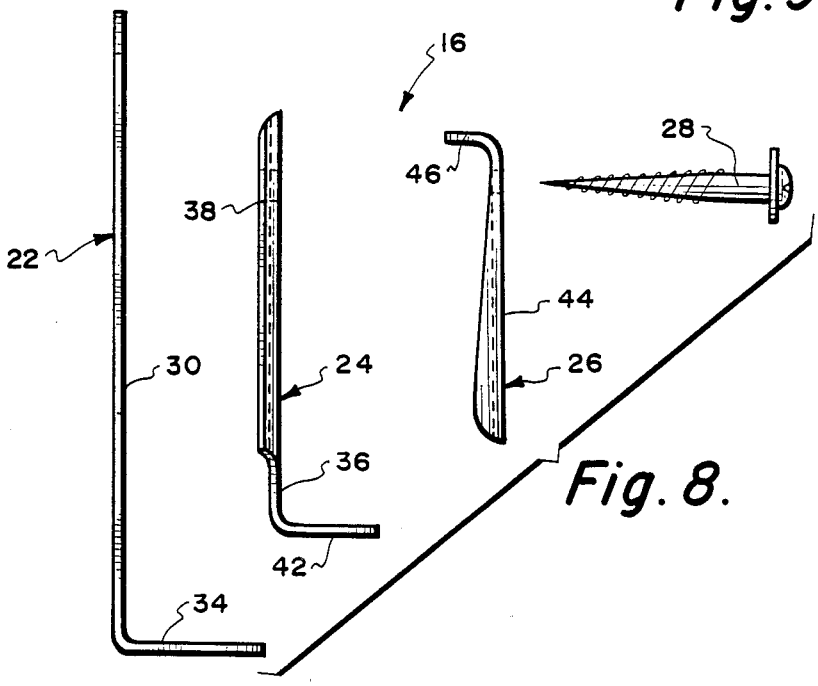
FIG. 8 is an exploded side elevational view of another embodiment of the three-piece hanger of the present invention together with a screw fastener.
Figure 10A:
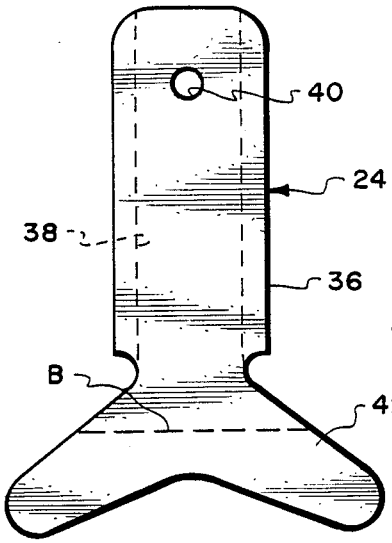
FIG. 10A is a front plan view of an unbent blank of a middle support member of the hanger of FIG. 8.
Figure 10B:
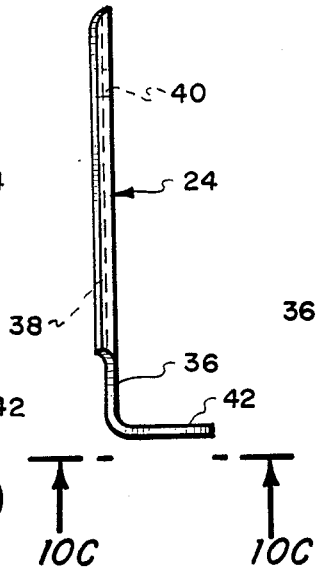
FIG. 10B is a side elevational view of the middle support member of the hanger of FIG. 8 after bending of the blank of FIG. 10A.
Figure 10C:
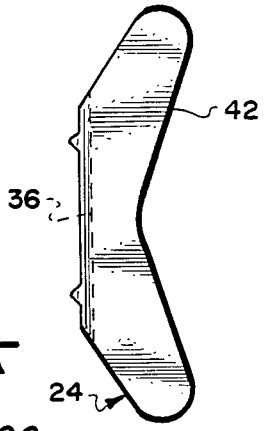
FIG. 10C is a bottom plan view of the middle support member as seen along line 10C—10C of FIG. 10B.
Figure 11A:
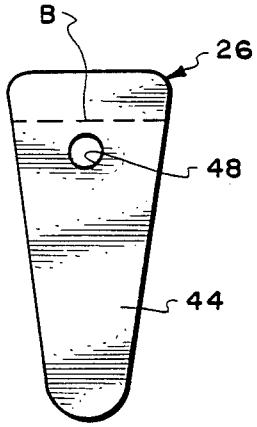
FIG. 11A is a front plan view of an unbent blank of a front support member of the hanger of FIG. 8.
Figure 11B:
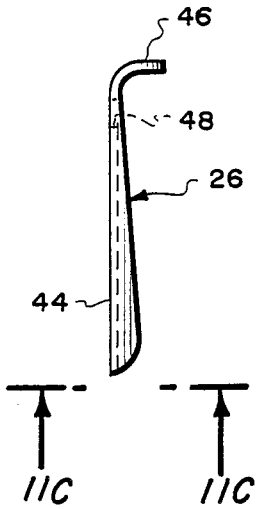
FIG. 11B is a side elevational view of the front support member of the hanger of FIG. 8 after bending of the blank of FIG. 11A.
Figure 11C:
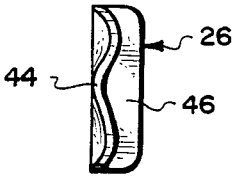
FIG. 11C is a bottom plan view of the front support member as seen along line 11C—11C of FIG. 11B.

It should now be readily apparent that the rear and middle members 22, 24 are adjustably movable relative to one another and so the space between their respective bracing portions 34 and 42 can be changed. As clearly seen in FIGS. 1, 6 and 7, the outer end 34A of the bracing portion 34 of the rear support member 22 is disposed outwardly beyond the outer end 42A of the bracing part 42 of the middle support member 24. Such arrangement allows the respective outer ends 34A, 42A together to define a pitch line L at a given angle relative to the vertical V. By the rear and middle members 22, 24 being slidable longitudinally relative to one another, the distance between their respective bracing portion 34 and part 42 and the positional relationship between their respective outer ends 34A, 42A can be varied. Such capability allows changing of the angle relative to the vertical V of the pitch line L defined by the outer ends, for example from sixteen degrees in FIG. 6 to ten degrees in FIG. 7 by increasing the distance between the outer ends. In such manner, the pitch line of the outer ends 34A, 42A can be matched with the particular pitch line of the tapered body 18 of a given plant pot 10 to be supported by the hanger 16.

In FIGS. 8–11, another embodiment of the hanger 16 is illustrated, having the rear, middle and front support members 22–26 substantially the same as those of the hanger 16 in FIGS. 1–5. However, now the hanger 16 is fabricated from a suitable metal, such as steel or aluminum. FIGS. 9A–11A illustrate the members 22–26 in blank form before being bent along respective bend lines B to form the respective bracing portion 34 and part 42 and engaging portion 46 thereof.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. In a plant pot hanger for releasably supporting a plant pot having a tapered body larger in size at an upper end than at a lower end thereof and an upper annular collar at the upper end of the body, the combination comprising:

(a) a rear support member including a bracing portion projecting outwardly to an outer end adapted to engage and laterally support the tapered body of the plant pot at a location spaced below the collar of the pot;

(b) a middle support member including a bracing part projecting outwardly to an outer end adapted to engage and laterally support the tapered body of the plant pot at a location spaced above said bracing portion of said rear support member and at a lower edge of the collar of the pot; and (c) a front support member adapted to engage an interior side of the collar of the pot and for attachment with said middle and rear support members to a generally vertical mounting surface;

(d) said outer end of said bracing portion of said rear support member being disposed outwardly beyond said outer end of said bracing part of said middle support member such that said respective outer ends together define a pitch line at a given angle relative to the vertical, said rear and middle support members being movable longitudinally relative to one another for varying the distance between their respective bracing portion and part and thereby changing the angle relative to the vertical of the pitch line defined by said outer ends thereof for matching the pitch line of the tapered body of the plant pot to be supported by said hanger.

2. The hanger of claim 1 wherein said rear support member includes an elongated mounting portion being adapted to engage the generally vertical mounting surface from which the plant pot is to be supported by said hanger.

3. The hanger of claim 2 wherein said mounting portion of said rear support member has a longitudinally-extending slot defined therethrough.

4. The hanger of claim 2 wherein said bracing portion of said rear support member is connected to and projects transversely outwardly from a lower end of said mounting portion thereof.

5. The hanger of claim 2 wherein said middle support member includes an elongated mounting part being adapted at a rear side thereof to engage said mounting portion of said rear support member and at a front side thereof to engage an exterior side of the collar of the pot.

6. The hanger of claim 5 wherein said mounting part of said middle support member has an elongated channel defined in said rear side thereof for slidably receiving said mounting portion of said rear support member.

7. The hanger of claim 5 wherein said mounting part of said middle support member has an aperture defined therethrough adjacent an upper end of said mounting part.

8. The hanger of claim 5 wherein said bracing part of said middle support member is connected to and projects transversely outwardly from a lower end of said mounting part thereof.

9. The hanger of claim 5 wherein said front support member includes an elongated retaining portion being adapted to engage the interior side of the collar of the pot.

10. The hanger of claim 9 wherein said retaining portion of said front support member has an aperture defined therethrough adjacent an upper end of said retaining portion.

11. The hanger of claim 9 wherein said front support member includes an engaging portion connected to and projecting transversely outwardly from an upper end of said retaining portion and being adapted at its outer end to engage said mounting part of said middle support member adjacent to an upper end thereof.

12. The hanger of claim 11 wherein said retaining portion of said front support member has an aperture defined therethrough adjacent said upper end of said retaining portion and below said engaging portion of said front support member.

13. The hanger of claim 12 wherein said mounting part of said middle support member has an aperture defined therethrough adjacent an upper end of said mounting part.

14. The hanger of claim 13 wherein said front support member is capable of being adjustably displaced along said middle support member for aligning said aperture of said front support member with said aperture of said middle support member above an upper edge of the collar of the pot when the latter is disposed between said retaining portion and mounting part of said respective front and middle support members.

15. The hanger of claim 14 wherein said mounting portion of said rear support member has a longitudinally-extending slot defined therethrough.

16. The hanger of claim 15 wherein said front and middle support members are capable of being adjustably displaced along said rear support member for aligning said apertures with said longitudinal slot in said rear support member for insertion of a fastener therethrough for attaching said support members to the generally vertical mounting surface.

17. A plant pot hanger for releasably supporting a plant pot having a tapered body larger in size at an upper end than at a lower end thereof and an upper annular collar at the upper end of the body, said hanger comprising:

(a) a rear support member including an elongated mounting portion and a bracing portion, said mounting portion having a longitudinally-extending slot defined therethrough and being adapted to engage a generally vertical mounting surface from which the plant pot is to be supported by said hanger, said bracing portion connected to and projecting outwardly from a lower end of said mounting portion and being adapted at an outer end of said bracing portion to engage and laterally support the tapered body of the plant pot at a location spaced below the collar of the pot;

(b) a middle support member including an elongated mounting part and a bracing part, said mounting part having an aperture defined therethrough and being adapted at a rear side thereof to engage said mounting portion of said rear support member and at a front side thereof to engage an exterior side of the collar of the pot, said bracing part connected to and projecting outwardly from a lower end of said mounting part and being adapted at an outer end of said bracing part to engage and laterally support the tapered body of the plant pot at a location spaced above said bracing portion of said rear support member and at a lower edge of the collar of the pot; and (c) a front support member including an elongated retaining portion and an engaging portion, said retaining portion having an aperture defined therethrough and being adapted to engage an interior side of the pot collar, said engaging portion connected to and projecting outwardly from an upper end of said retaining portion and being adapted at its outer end to engage said mounting part of said middle support member adjacent to an upper end thereof, said front support member being adjustably displaceable along said middle support member for aligning said aperture of said front support member with said aperture of said middle support member above an upper edge of the collar of the pot when the latter is disposed between said retaining portion and mounting part of said respective front and middle support members, said front and middle support members being adjustably displaceable along said rear support member for aligning said apertures with said longitudinal slot in said rear support member for insertion of a fastener therethrough for attaching said support members to the mounting surface;

(d) said outer end of said bracing portion of said rear support member being disposed outwardly beyond said outer end of said bracing part of said middle support member such that said respective outer ends together define a pitch line at a given angle relative to the vertical, said rear and middle support members being slidable longitudinally relative to one another at their respective mounting portion and part for varying the distance between their respective bracing portion and part and thereby changing the angle relative to the vertical of the pitch line defined by said outer ends thereof for matching the pitch line of the tapered body of the plant pot to be supported by said hanger.

18. The hanger of claim 17 wherein said mounting part of said middle support member has an elongated channel defined in said rear side thereof for slidably receiving said mounting portion of said rear support member.

* * * * *